US009516438B2

(12) United States Patent
Andersen et al.

(10) Patent No.: US 9,516,438 B2
(45) **Date of Patent: *Dec. 6, 2016**

(54) HEARING AID FITTING SYSTEM AND A METHOD OF FITTING A HEARING AID SYSTEM

(71) Applicant: Widex A/S, Lynge (DK)

(72) Inventors: Svend Vitting Andersen, Humlebaek (DK); Anders Westergaard, Herlev (DK)

(73) Assignee: Widex A/S, Lynge (DK)

( * ) Notice: Subject to any disclaimer, the term of this patent is extended or adjusted under 35 U.S.C. 154(b) by 181 days.

This patent is subject to a terminal disclaimer.

(21) Appl. No.: 14/338,495

(22) Filed: Jul. 23, 2014

(65) Prior Publication Data

US 2014/0334629 A1 Nov. 13, 2014

Related U.S. Application Data

(63) Continuation-in-part of application No. PCT/EP2012/052000, filed on Feb. 7, 2012.

(51) Int. Cl.
*H04R 25/00* (2006.01)

(52) U.S. Cl.
CPC ..... *H04R 25/70* (2013.01); *H04R 2225/55* (2013.01)

(58) Field of Classification Search
CPC ..... H04R 2225/55; H04R 25/70; G06F 21/10; H04L 63/0876
See application file for complete search history.

(56) References Cited

U.S. PATENT DOCUMENTS

| | | | | |
|---|---|---|---|---|
| 6,850,775 | B1 * | 2/2005 | Berg | H04R 25/70 381/315 |
| 8,077,891 | B2 * | 12/2011 | Hasler | H04R 25/70 381/314 |
| 8,718,288 | B2 * | 5/2014 | Woods | 381/312 |
| 9,326,077 | B2 * | 4/2016 | Sommer | H04M 1/7253 |
| 9,357,317 | B2 * | 5/2016 | Eaton | H04R 25/70 |
| 9,363,348 | B2 * | 6/2016 | Jellinek | H04M 1/6066 |
| 2002/0066094 | A1 * | 5/2002 | Futakuchi | G06F 8/61 717/172 |

(Continued)

FOREIGN PATENT DOCUMENTS

| | | | |
|---|---|---|---|
| DE | 19600234 | A1 | 7/1997 |
| DE | 29905172 | U1 | 7/1999 |
| WO | 2011128462 | A2 | 10/2011 |

OTHER PUBLICATIONS

International Search Report for PCT/EP2012/052000 dated May 23, 2012.

(Continued)

*Primary Examiner* — Matthew Eason
(74) *Attorney, Agent, or Firm* — Sughrue Mion, PLLC

(57) ABSTRACT

A hearing aid fitting system (100, 200, 300) adapted for remote fitting of a hearing aid system (110), wherein a direct communication channel between a hearing aid fitting part and an external device (102, 302), adapted to communicate directly with the hearing aid system (110), is established by a control server (103) based on unique identifications of the hearing aid user and the external device and the hearing aid system. The invention also provides a method of remote fitting of a hearing aid system.

12 Claims, 4 Drawing Sheets

(56) References Cited

U.S. PATENT DOCUMENTS

2005/0283263 A1* 12/2005 Eaton ..... H04R 25/554 700/94
2007/0255435 A1* 11/2007 Cohen ..... H04R 1/1016 700/94
2008/0037798 A1* 2/2008 Baechler ..... H04R 25/30 381/60
2010/0205447 A1* 8/2010 Waldmann ..... H04R 25/70 713/182
2010/0208922 A1* 8/2010 Erni ..... H04R 25/554 381/315
2011/0072507 A1* 3/2011 Johnston, II ..... H04L 63/0853 726/12
2011/0176686 A1* 7/2011 Zaccaria ..... H04R 25/70 381/60
2013/0202138 A1* 8/2013 Nishizaki ..... H04R 25/70 381/315
2013/0294626 A1* 11/2013 Young ..... H04R 25/558 381/315
2013/0329924 A1* 12/2013 Fleizach ..... H04R 25/558 381/314
2015/0023512 A1* 1/2015 Shennib ..... H04R 25/70 381/60
2015/0036851 A1* 2/2015 Howes ..... H04R 25/554 381/314
2015/0195661 A1* 7/2015 Neumann ..... H04R 5/04 381/60
2015/0281863 A1* 10/2015 Westergaard ..... H04R 25/70 381/60
2015/0296308 A1* 10/2015 Fluckiger ..... H04R 25/70 715/733
2016/0044425 A1* 2/2016 Westergaard ..... H04R 25/558 381/315

OTHER PUBLICATIONS

International Preliminary Report on Patentability for PCT/EP2012/052000 dated Apr. 23, 2014.

* cited by examiner

HEARING AID FITTING SYSTEM AND A METHOD OF FITTING A HEARING AID SYSTEM

RELATED APPLICATIONS

The present application is a continuation-in-part of application No. PCT/EP2012052000, filed on Feb. 7, 2012, with the European Patent Office and published as WO-A1-2013117214.

BACKGROUND OF THE INVENTION

1. Field of the Invention

The present invention relates to hearing aid fitting systems. The present invention also relates to a method of fitting a hearing aid system.

In the context of the present disclosure, a hearing aid should be understood as a small, microelectronic device designed to be worn behind or in a human ear of a hearing-impaired user. A hearing aid system may be monaural and comprise only one hearing aid or be binaural and comprise two hearing aids. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer. The signal processor is preferably a digital signal processor. The hearing aid is enclosed in a casing suitable for fitting behind or in a human ear.

In a traditional hearing aid fitting, the hearing aid user travels to an office of a hearing aid fitter and the user's hearing aids are adjusted using the fitting equipment that the hearing aid fitter has in his office. Typically the fitting equipment comprises a computer capable of executing the relevant hearing aid programming software and a programming device adapted to provide the link between the computer and the hearing aid. This procedure is disadvantageous in cases where it is difficult or expensive for the hearing aid user to visit a hearing aid fitting office.

2. The Prior Art

Methods for remote fitting of hearing aids have been proposed in the art.

DE-A1-19600234 discloses a method of fitting a hearing aid, wherein data are transmitted from the fitting equipment and to the hearing aid using a remote data transmission link such that the hearing aid fitting can be carried out practically independent on the distance between the hearing aid user and the hearing aid fitter. In one embodiment the system comprises two computers that are connected using an ISDN link and in another embodiment one of the two computers comprises means for transforming the data, received over the transmission link, into a data format that can be understood by the hearing aid.

DE-U1-29905172 discloses a programming device that can be coupled directly to a telephone line, a modem or a computer, whereby data can be transmitted to and from the programming device. The programming device is adapted to access and adjust the setting of a hearing aid. In this way the hearing aid fitter can adjust the setting of a distant hearing aid using the programming device and a telephone line for providing the data transmission link between the programming device and the fitting software located within the hearing aid fitter's office.

WO-A2-2011/128462 discloses a method for providing distant support to a plurality of personal hearing aid users. Prior to a support session, users are paired with providers by storing a pairing information and when starting a support session, the stored pairing information is used to determine a support provider. According to an embodiment, data exchanged between the user computer and the supporter computer is relayed by a relay server, whereby both user and support provider may be located behind a firewall.

The methods disclosed in WO-A2-2011/128462 are disadvantageous in that they require the hearing aid user to start an application software that may have to be installed on the user's computer and establish a data connection between the personal hearing system and the user computer. Especially since many hearing aid users are elderly it can not be presumed that the hearing aid user is familiar with computers and/or can figure out how to initiate a request for support.

The methods disclosed in WO-A2-2011/128462 are also disadvantageous in that a support provider is determined based on stored pairing information that links the hearing aid user to a specific support provider and in that a data connection is established between two computers located respectively at a support provider and at the support requesting user. The disclosed method is therefore inflexible with respect to the choice of support provider and the location of the support provider.

Furthermore the embodiments disclosed in WO-A2-2011/128462 are inflexible with respect to the possibility for a skilled hearing aid user to carry out relatively simple support operations such as fine tuning of his hearing aid system using a fitting software server that is located remotely from the hearing aid user.

It is therefore a feature of the present invention to provide a hearing aid fitting system that allows distant support to be provided by basically any qualified support provider.

It is another feature of the present invention to provide a hearing aid fitting system for remote fitting that does not require the hearing aid user to install or maintain software.

It is still another feature of the present invention to provide a hearing aid fitting system that allows the hearing aid user to fine tune his hearing aid system using a remote hearing aid fitting software server.

It is yet another feature of the present invention to provide a hearing aid fitting system that can perform a remote fitting with a programming device that is independent on the selected software platform for the fitting software.

It is still another feature of the present invention to provide an improved method for remote fitting of a hearing aid.

SUMMARY OF THE INVENTION

The invention, in a first aspect, provides a hearing aid remote fitting system comprising a first client, an external device, a control server, and link means adapted to allow the first client, the external device and, the control server to communicate with a hearing aid system, wherein said first client comprises fitting software adapted to fit the hearing aid system based on a selected hearing aid user profile having a unique user identification and fitting connection software means adapted to request said control server to establish a communication channel between said first client and said external device, wherein said external device comprises a unique device identification, external device connection software means adapted to provide said unique device identification to the control server, redirecting means adapted to direct the content of the data transmitted over said direct communication channel to the hearing aid system, and wherein said control server comprises a look-up database holding pairs of unique hearing aid user identifications and unique device identifications, and interface means adapted to provide the direct communication channel between the first client and the external device based on corresponding user and device identifications, wherein said remote fitting system is adapted such that data for fitting the hearing aid system are transmitted using said first client, said communication channel and said external device.

This provides a hearing aid fitting system that allows any qualified support provider to carry out the remote fitting.

The invention, in a second aspect, provides a method of remote fitting a hearing aid system comprising the steps of providing a first client, an external device, and a control server, providing a unique hearing aid user identification, providing a unique device identification, storing a set of paired hearing aid user and device identifications in the control server, using the first client to select a hearing aid user and retrieve the corresponding hearing aid user identification, using the first client to request the control server to retrieve the device identification that is paired with the retrieved hearing aid user identification, using the first client to request the control server to establish a communication channel between the first client and the external device corresponding to the retrieved device identification, using the control server to establish a communication channel between the first client and the external device, using the first client, the communication channel and the external device to remotely fit the hearing aid system.

This provides an improved method of remotely fitting a hearing aid system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
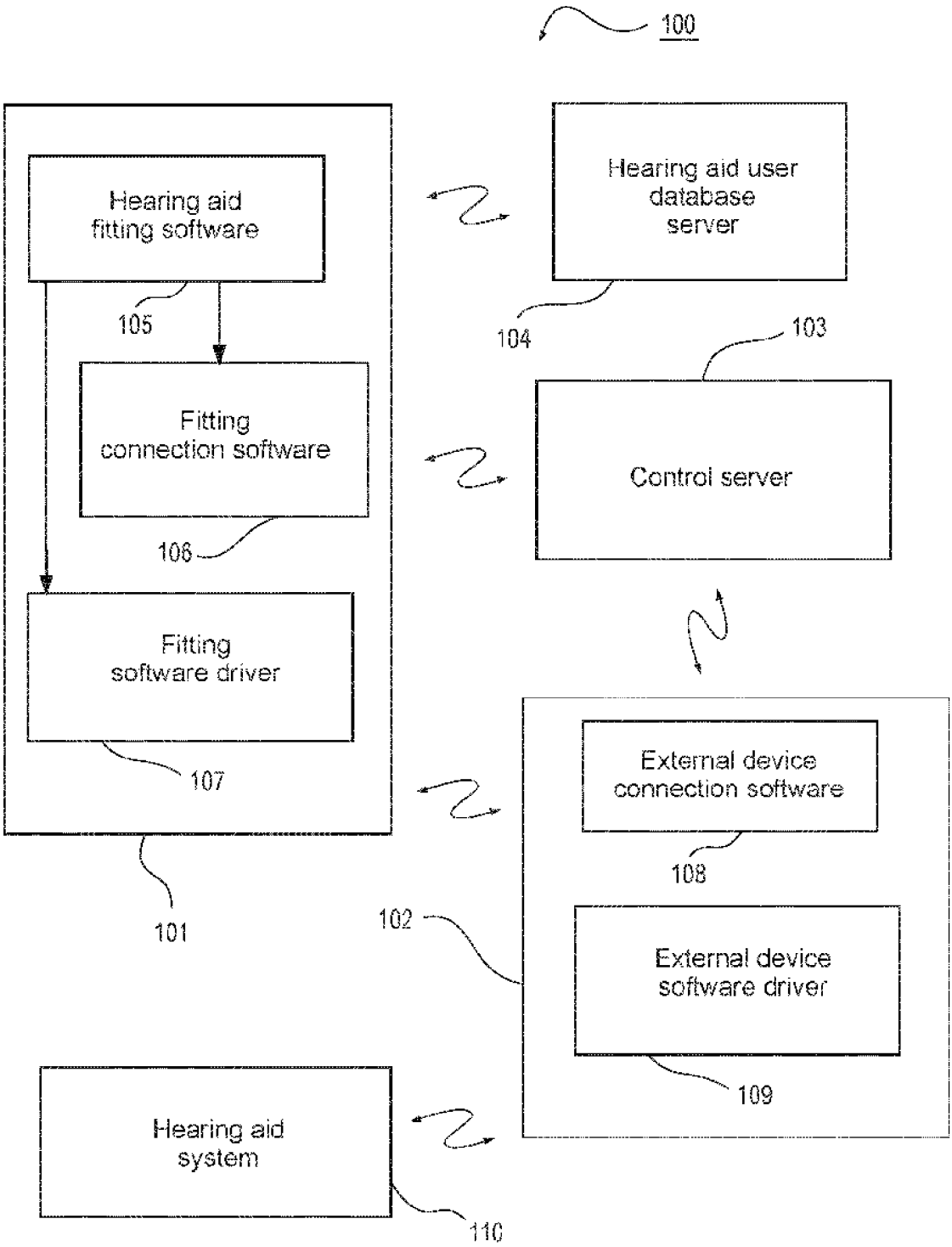
FIG. 1 illustrates highly schematically a hearing aid fitting system according to a first embodiment of the invention.

Reference is first made to FIG. 1, which illustrates highly schematically a hearing aid fitting system 100 according to a first embodiment of the invention. The hearing aid fitting system 100 comprises a first client 101, an external device 102, a control server 103, a hearing aid user database server 104 and a hearing aid system 110.

The first client 101 further comprises hearing aid fitting software 105, a fitting connection software 106 and a fitting software driver 107. The external device 102 comprises an external device connection software 108 and an external device software driver 109.

The control server 103 comprises a look-up database that holds pairs of unique hearing aid user identifications and unique hearing aid system identifications.

The individual components of the hearing aid fitting system 100 are further described below in association with an explanation of the method steps carried out in a normal hearing aid fitting session using the fitting system 100 according to the first embodiment of the invention.

In a typical situation the hearing aid fitter will initially provide said pairing information to the look-up database on the control server 103 when a hearing aid user receives his hearing aid system 110 and an external device 102.

In a variation of the FIG. 1 embodiment the look-up database is located on a separate server, instead of as a part of the control server.

In another variation of the FIG. 1 embodiment the unique hearing aid system identification is replaced by a unique external device identification. In this way the pairing information stored in the control server does not have to be updated if e.g. the hearing aid user replaces his hearing aid system. Furthermore it adds to the complexity of the external device and the hearing aid system if the external device is adapted to read out a unique hearing aid system identification from the hearing aid system 110.

In the following the generic term unique device identification may be used to denote both the unique hearing aid system identification and the unique external device identification.

When the hearing aid user returns to his home after his visit at the hearing aid fitter and starts using his hearing aid system, it may be that the hearing aid user after a while wishes to have his hearing aid system fine tuned to better suit his personal preferences. To this end the external device 102 is powered up, connected to the internet and positioned within range of the hearing aid system 110, whereafter the external device connection software 108 establishes contact to the hearing aid system 110 and reads the unique hearing aid system identification code. Next the external device connection software 108 establishes contact to the control server 103 and provides the unique hearing aid system identification code, hereby also reporting to the control server 103 that the external device 102 is online. Basically these steps can be carried out at any time prior to the remote fitting.

The remote fitting is carried out in the following manner: using the hearing aid fitting software 105 the hearing aid fitter initially accesses a hearing aid user database server 104 selecting an entry for a hearing aid user, for whom fitting of a hearing aid system 100 is to be carried out. A unique hearing aid user identification code is assigned to each hearing aid user. Based on said selection the fitting connection software 106 establishes contact to the control server 103, provides the unique hearing aid user identification code and requests the control server 103 to establish a direct communication channel, based on said look-up database, with the external device 102—that has read the unique hearing aid system identification from the hearing aid system 110—and through the interaction of the external device 102 a remote fitting of the hearing aid system 110 can be carried out.

According to the embodiment of FIG. 1 data exchanged between the external device 102 and the hearing aid system 110 are transmitted using wireless link means.

In the following the generic term redirecting means may be used to denote the external device means providing that the data received over the direct communication channel is directed to the hearing aid system.

In a variation according to the embodiment of FIG. 1 data from the external device 102 and to the hearing aid system 110 are transmitted using wired link means.

The database server 104 further comprises, for each hearing aid user, data such as hearing loss, and details concerning current and prior fittings. In a variation according to the embodiment of FIG. 1 the database server 104 is integrated as part of the first client 101.

According to the embodiment of FIG. 1 the fitting software driver 107 transforms the data output from the hearing aid fitting software 105 into a format suitable for transmitting the data to the external device using an Ethernet connection. When the data reach the external device 102, the external device software driver 109 transforms the received data into a format suitable for transmitting the data to the hearing aid system 110. This data format is normally based on a proprietary protocol that varies for the individual hearing aid system manufacturers.

According to the embodiment of FIG. 1 the external device 102 is implemented as an embedded device that is adapted to be inserted directly into an Ethernet connection of a standard internet modem and to receive such data.

The hearing aid fitting system according to the embodiment of FIG. 1 is advantageous in that a remote fitting can be carried out in a simple manner through the use of the fitting connection software 106 and the fitting software driver 107 that transforms the output data from the fitting software into a data format that is suitable for transmission over the internet whereby the external device can be implemented as an embedded device that is adapted to be inserted directly into a connection of a standard internet modem. This makes the external device 102 independent on the selected fitting software platform.

Hereby the embodiment according to FIG. 1 is advantageous in that all that is required of the hearing aid user in order to enable the remote fitting according to the invention is to insert the external device 102 into an Ethernet connection and position the hearing aid system 110 within range of the wireless link means of the external device 102.

The embodiment according to FIG. 1 is further advantageous in that it enables existing hearing aid fitting software to remotely fit existing hearing aid systems without having to modify the fitting software itself.

Thus the embodiment of FIG. 1 is particularly advantageous for a hearing aid fitter that wishes to remotely fit a hearing aid user, such that the hearing aid user it not required to make several follow-up visits to the office of the hearing aid fitter.

Figure 2:
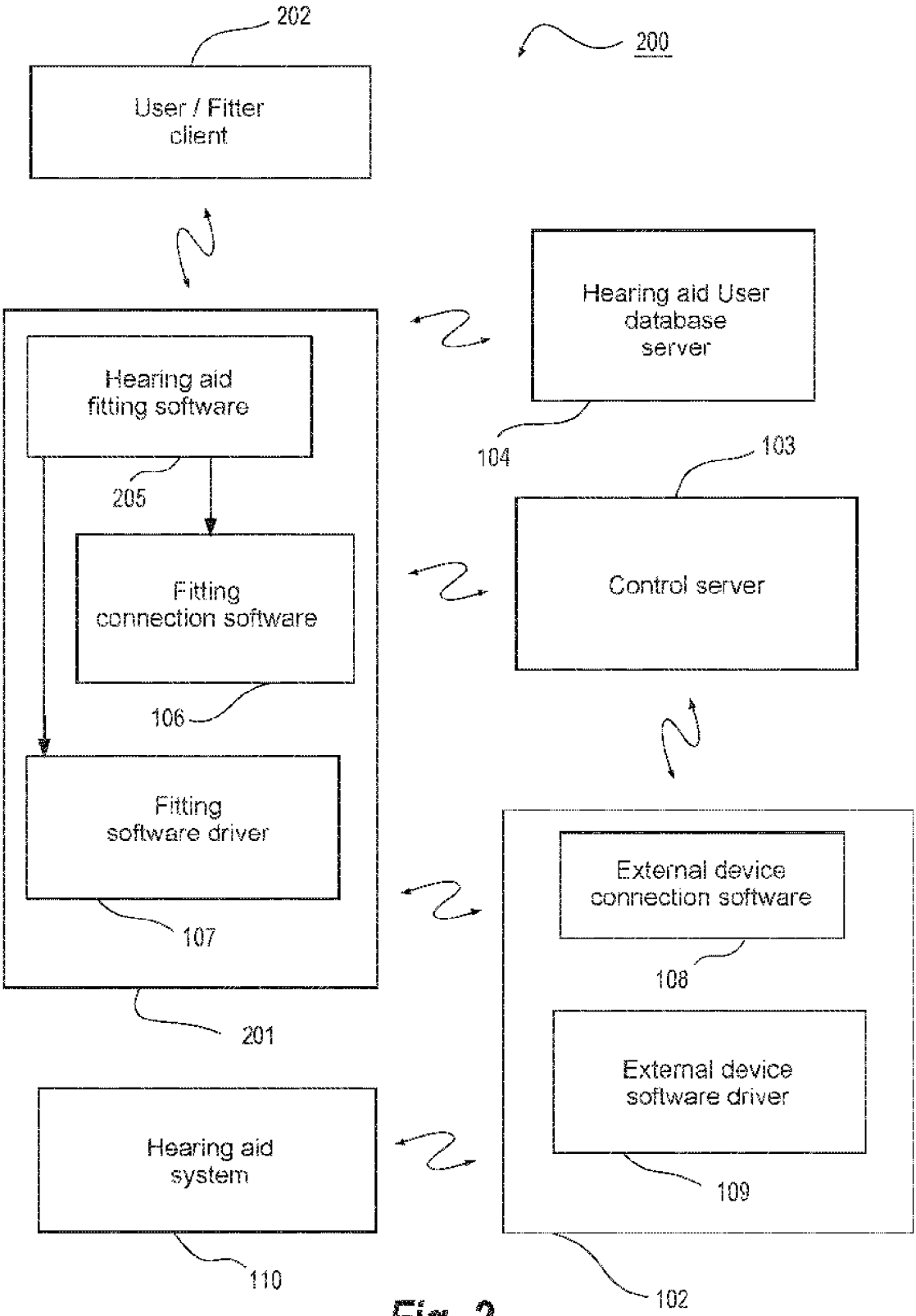
FIG. 2 illustrates highly schematically a hearing aid fitting system according to a second embodiment of the invention.

Reference is now made to FIG. 2, which illustrates highly schematically a hearing aid fitting system according to a second embodiment of the invention.

The hearing aid fitting system 200 of FIG. 2 comprises basically the same elements as the hearing aid fitting system 100 of FIG. 1, except that the first client 101 is now split into a user client 202 and a hearing aid fitting server 201.

The user client 202 is a simple device having a web browser (this type of device may also be denoted a thin client). The hearing aid fitting server 201 comprises the fitting connection software 106 and driver 107 already described with reference to FIG. 1 and the hearing aid fitting software 205 implemented as a web service such that no hearing aid fitting software needs to be installed on the user client 202. A web browser is all that is required in order to fit a hearing aid system using the user client 202. Especially the web service of the hearing aid fitting software 205 provides the graphical user interface to the user client 202.

The embodiment of FIG. 2 is especially advantageous in that the user client is a generic device that is platform-independent and in that the communication between the user client 202 and the hearing aid fitting server 201 is independent of the selected platform for the hearing aid fitting server 201.

The user client 202 according to the embodiment of FIG. 2 can therefore be any type of web enabled device, such as a smart phone or tablet PC, independent on operating system.

Figure 3:
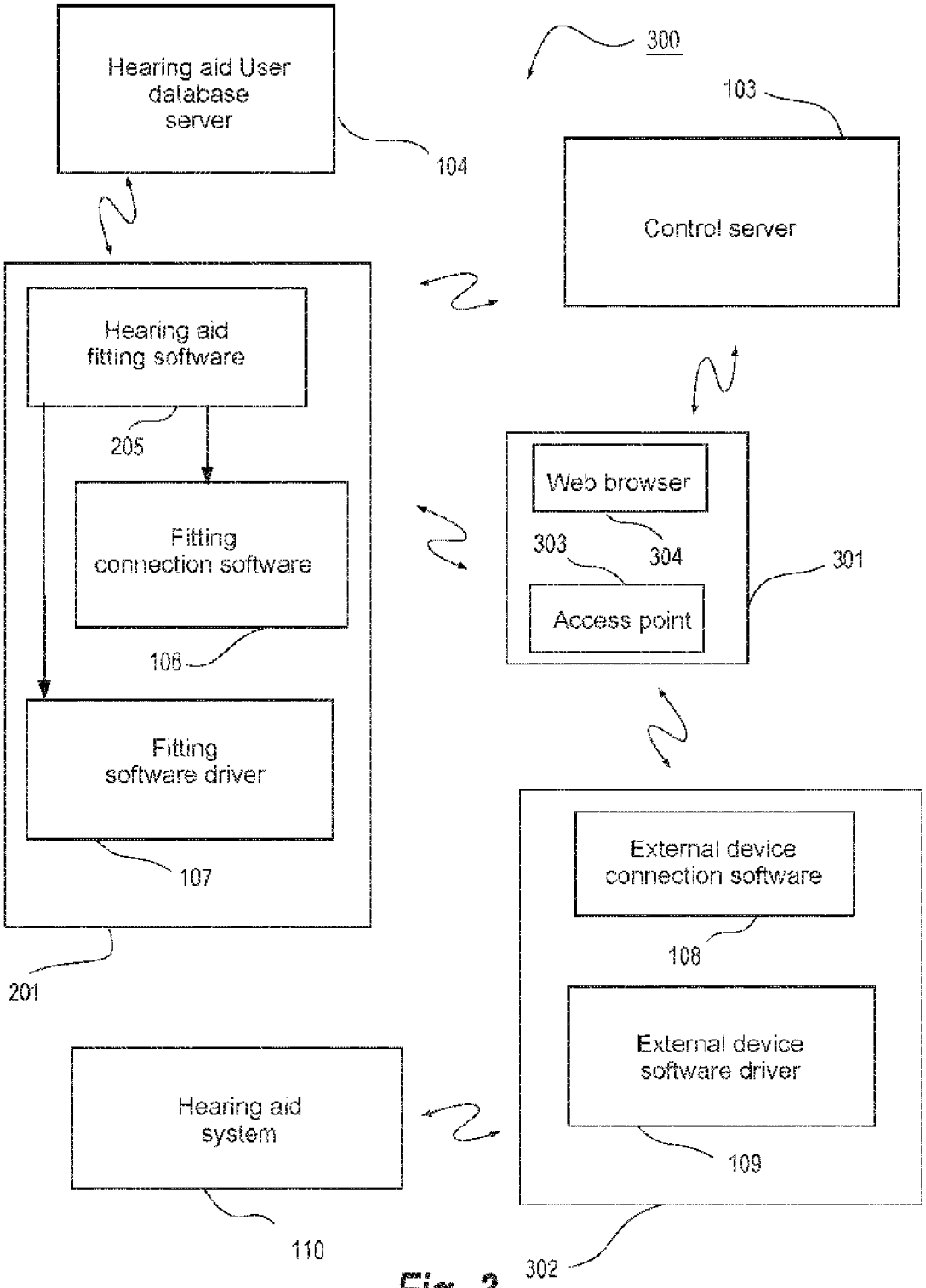
FIG. 3 illustrates highly schematically a hearing aid fitting system according to a third embodiment of the invention.

Reference is now made to FIG. 3, which illustrates highly schematically a hearing aid fitting system 300 according to a third embodiment of the invention.

The hearing aid fitting system 300 of FIG. 3 comprises basically the same elements as the hearing aid fitting system 200 of FIG. 2, except that the user client 301 in addition to the web browser 304 comprises a wireless access point 303 and that the external device 302 comprises wireless link means that enables the external device 302 to establish the initial contact to the control server 103 and the direct communication channel to the hearing aid fitting server 201 using the wireless access point 303 of the user client 301.

The embodiment of FIG. 3 is especially advantageous in that a hearing user only requires the user client 301, the external device 302 and internet access in order to fit a hearing aid system. The hearing aid fitting system 300 according to the embodiment of FIG. 3 does not require a modem because the external device 302 connects to the internet through the access point 303 of the user client 301.

According to a variation of the embodiment of FIG. 3 the user client 301 is a smart phone or a tablet PC.

In variations of the embodiment of FIG. 3 the external device 302 seeks to establish contact to the control server 103 as soon as the external device is powered up.

In a variation of the FIG. 2 and FIG. 3 embodiments the hearing aid fitting software 205 of the first client 201 is distributed on a graphical user interface server and a hearing aid fitting server.

Figure 4:
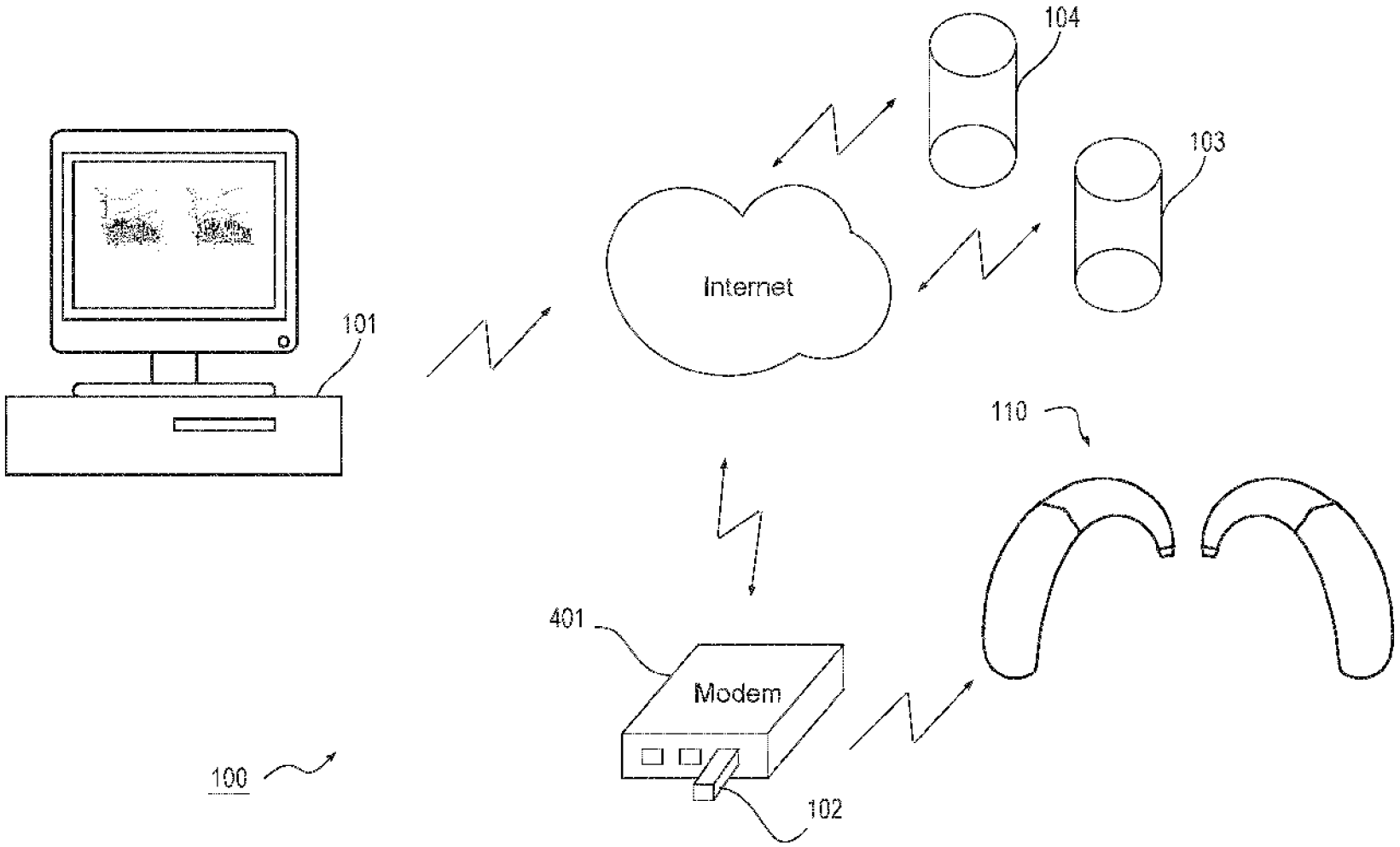
FIG. 4 illustrates in a more graphical manner a hearing aid fitting system according to the first embodiment of the invention.

Reference is finally made to FIG. 4 which illustrates in a more graphical manner the hearing aid fitting system 100 according to the first embodiment of the invention.

The hearing aid fitting system 100 comprises a first client 101, an external device 102, a control server 103, a hearing aid user database server 104 and a hearing aid system 110.

Additionally a standard modem 401 is illustrated, whereto the external device 102 is connected using an Ethernet connection.

In variations according to the disclosed embodiments the external device 102, 302 comprises a unique device identification that is provided to a basic communication establishing server that based on said unique device identification enables the external device 102, 302 to provide the unique hearing aid system identification to a specific one among several control servers, whereby an efficient arrangement of the control servers can be achieved.

In other variations according to the disclosed embodiments, the external device is not implemented as an embedded device. Within the present context an embedded device is defined by being designed only for carrying out specific functions within a larger system. By contrast, a general-purpose computer, such as a personal computer (PC), is designed to be flexible and to meet a wide range of end-user needs.

In variations according to the disclosed embodiments the Ethernet protocol and connections may be substituted with other suitable protocols and connections.

In still another variation of the disclosed embodiments, the communication channel between the first client 101 and the external device 102 is established using Transmission Control Protocol (TCP) or User Datagram Protocol (UDP) hole punching, mediated by the control server 103.

In still another variation of the disclosed embodiments, the data provided to the hearing aid system using the fitting system comprises hearing aid system software updates. This provides a very versatile method whereby the hearing aid system software can be updated without the hearing aid user needing to visit a hearing aid fitter and without the hearing aid user needing to install and/or operate any computer software.

We claim:

1. A hearing aid remote fitting system comprising a first client, an external device, a control server, and communications hardware in each of saif first client, external device and control server to allow the first client, the external device and the control server to communicate with a hearing aid system, wherein said first client comprises fitting software configured to fit the hearing aid system based on a selected hearing aid user profile having a unique user identification and fitting connection software configured to request said control server to establish a communication channel between said first client and said external device, wherein said external device comprises a unique device identification, external device connection software configured to provide said unique device identification to the control server, a redirector configured to direct the content of the data transmitted over said direct communication channel to the hearing aid system, and wherein said control server comprises a look-up database holding pairs of unique hearing aid user identifications and unique device identifications, and an interface configured to provide the direct communication channel between the first client and the external device based on corresponding user and device identifications, wherein said remote fitting system is adapted such that data for fitting the hearing aid system are transmitted using said first client, said communication channel and said external device.

2. The hearing aid fitting system according to claim 1, wherein said first client comprises a fitting software driver configured to code the protocol used for the fitting software output into a protocol suitable for transmission in said direct communication channel.

3. The hearing aid fitting system according to claim 1, wherein said external device redirector comprises an external device software driver configured to code the protocol used for transmission in said communication channel into a protocol suitable for communication with the hearing aid system.

4. The hearing aid fitting system according to claim 1, wherein said unique device identification is a unique hearing aid system identification retrieved by, or coded into, the external device.

5. The hearing aid fitting system according to claim 1, wherein said unique device identification is a unique external device identification.

6. The hearing aid fitting system according to claim 1, wherein the Ethernet protocol is used for coding the data transmitted over said communication channel.

7. The hearing aid fitting system according to claim 1 wherein said first client comprises a sub client comprising a web browser and a fitting server part comprising the fitting software, a corresponding graphical user interface and the fitting connection software.

8. The hearing aid fitting system according to claim 7, wherein said sub client comprises a wireless Ethernet access point whereby said external device can connect to the internet through said sub client.

9. The hearing aid fitting system according to claim 7, wherein said sub client is smart phone or a tablet PC.

10. The hearing aid fitting system according to claim 1 wherein said fitting system is adapted to provide and install data comprising hearing aid system software updates.

11. A method of remote fitting a hearing aid system comprising the steps of:

providing a first client, an external device, and a control server, providing a unique hearing aid user identification, providing a unique device identification, storing a set of paired hearing aid user and device identifications in the control server, using the first client to select a hearing aid user and retrieve the corresponding hearing aid user identification, using the first client to request the control server to retrieve the device identification that is paired with the retrieved hearing aid user identification, using the first client to request the control server to establish a communication channel between the first client and the external device corresponding to the retrieved device identification, using the control server to establish a communication channel between the first client and the external device, using the first client, the communication channel and the external device to remotely fit the hearing aid system.

12. The method according to claim 11, wherein said communication channel is established using Transmission Control Protocol (TCP) or User Datagram protocol hole punching, mediated by the control server.

* * * * *